US012656034B2

(12) United States Patent
Jairazbhoy et al.

(10) Patent No.: US 12,656,034 B2
(45) Date of Patent: Jun. 16, 2026

(54) ELECTRIC VEHICLE HEAT EXCHANGER DEICING SYSTEM

(71) Applicant: FCA US LLC, Auburn Hills, MI (US)

(72) Inventors: Vivek A Jairazbhoy, Farmington Hills, MI (US); Drushan Mavalankar, Rochester Hills, MI (US); Timothy C Scott, Charlottesville, VA (US); Frederica Bettoja, Turin (IT)

(73) Assignee: FCA US LLC, Auburn Hills, MI (US)

( * ) Notice: Subject to any disclaimer, the term of this patent is extended or adjusted under 35 U.S.C. 154(b) by 139 days.

(21) Appl. No.: 18/520,829

(22) Filed: Nov. 28, 2023

(65) Prior Publication Data

US 2025/0172324 A1 May 29, 2025

(51) Int. Cl.
*F25B 47/02* (2006.01)

(52) U.S. Cl.
CPC ..... *F25B 47/022* (2013.01); *F25B 2339/047* (2013.01); *F25B 2600/2513* (2013.01); *F25B 2700/1933* (2013.01)

(58) Field of Classification Search
CPC ..... F25B 47/022; F25B 2339/047; F25B 2600/2513; F25B 2700/1933
See application file for complete search history.

(56) References Cited

U.S. PATENT DOCUMENTS

| | | | | |
|---|---|---|---|---|
| 10,639,965 | B2 | 5/2020 | Quetant et al. | |
| 2016/0332504 | A1 | 11/2016 | Blatchley et al. | |
| 2021/0068312 | A1* | 3/2021 | Tobiassen | H01M 10/663 |
| 2021/0316593 | A1* | 10/2021 | Ishizeki | B60H 1/00785 |

FOREIGN PATENT DOCUMENTS

CN 110715401 A * 1/2020

OTHER PUBLICATIONS

Wen et al., Defrosting Control Method and Device of Air Conditioning Device . . . , Jan. 21, 2020, CN110715401A, Whole Document (Year: 2020).*

* cited by examiner

*Primary Examiner* — Larry L Furdge
(74) *Attorney, Agent, or Firm* — Jeremy J. Klobucar

(57) ABSTRACT

A thermal system for a vehicle includes a refrigerant loop operable between a cooling mode and a heat pump mode, a compressor configured to circulate a refrigerant through the refrigerant loop, and a heat exchanger disposed on the refrigerant loop and configured to operate as a condenser when operating in the cooling mode and operate as an evaporator when operating in the heat pump mode. A thermal control system includes a controller having one or more processors. The controller is programmed to perform an assessment of ambient conditions, estimate an incremental ice formation on the heat exchanger based on the assessed ambient condition, and initiate a deicing operation of the heat exchanger when the incremental ice formation exceeds a predetermined threshold.

20 Claims, 5 Drawing Sheets

ELECTRIC VEHICLE HEAT EXCHANGER DEICING SYSTEM

FIELD

The present application relates generally to vehicle thermal systems and, more particularly, to a thermal control system for heat exchanger scheduled deicing.

BACKGROUND

Some electric vehicles (EVs) utilize a heat pump to provide heat to the vehicle cabin and/or powertrain. The heat pump includes a heat exchanger configured to extract heat from ambient air to heat a refrigerant. However, during operation, the refrigerant temperature in the heat exchanger can drop well below freezing. As a result, moisture in the ambient air can freeze and cause ice buildup on surfaces of the heat exchanger. Unattended, the ice and frost layers can block the airflow passages and potentially incapacitate the heat pump. Detection of excessive ice buildup is difficult, and detection of a drop in performance of the heat exchanger is also complicated because the refrigerant can flow in a two-phase state, and convenient measurement of phase fractions may be hard to perform in a cost effective manner. Accordingly, while such conventional systems do work for their intended purpose, there is a desire for improvement in the relevant art.

SUMMARY

In accordance with one example aspect of the invention, a thermal system for a vehicle is provided. In one example implementation, the thermal system includes a refrigerant loop operable between a cooling mode and a heat pump mode, a compressor configured to circulate a refrigerant through the refrigerant loop, and a heat exchanger disposed on the refrigerant loop and configured to operate as a condenser when operating in the cooling mode and operate as an evaporator when operating in the heat pump mode. A thermal control system includes a controller having one or more processors. The controller is programmed to perform an assessment of ambient conditions, estimate an incremental ice formation on the heat exchanger based on the assessed ambient condition, and initiate a deicing operation of the heat exchanger when the incremental ice formation exceeds a predetermined threshold.

In addition to the foregoing, the described thermal system may include one or more of the following features: wherein the incremental ice formation is a thickness of ice, and wherein the predetermined threshold is a predetermined threshold thickness; wherein the deicing operation includes switching the refrigerant loop from the heat pump mode to the cooling mode such that hot refrigerant from the compressor transfers thermal energy to the heat exchanger to facilitate melting ice formed thereon; wherein the controller is further programmed to perform a screening test to determine if an icing risk exists for the heat exchanger while operating in the heat pump mode; and wherein the screening test includes determining, by the controller, at least one of the following: (i) determining if the refrigerant loop is operating in the heat pump mode, (ii) determining if a temperature of the refrigerant entering the heat exchanger is greater than the ambient temperature, (iii) determining if a saturation temperature of the refrigerant at an exit of the heat exchanger is below zero ° C. or if the ambient temperature is below zero ° C., and (iv) determining if a compressor suction pressure or a vehicle cabin temperature is below a predetermined threshold.

In addition to the foregoing, the described thermal system may include one or more of the following features: wherein when performing the assessment of ambient conditions, the controller identifies one of a first condition with no precipitation or wet pavement, a second condition with wet pavement, but no precipitation, and a third condition with precipitation; wherein the controller determines the presence of precipitation based on one or more signals from a rain sensor and/or a windshield wiper speed, and wherein the controller determines the presence of wet pavement based on traction signals from the vehicle; and wherein when estimating the incremental ice formation, the controller is further programmed to interpolate, based on the assessed ambient conditions, a table or an artificial neural network for incremental icing versus at least one of the following: an intensity of road splash, an external humidity, the ambient temperature, an airflow to the heat exchanger, a refrigerant state at an inlet of the heat exchanger or an upstream expansion device, a refrigerant pressure at an exit of heat exchanger, and a refrigerant flow.

In addition to the foregoing, the described thermal system may include one or more of the following features: an evaporator disposed on the refrigerant loop downstream of the heat exchanger, and a condenser disposed on the refrigerant loop upstream of the heat exchanger; and a first expansion device disposed downstream of the condenser and upstream of the heat exchanger, and a second expansion device disposed downstream of the heat exchanger and upstream of the evaporator.

In accordance with another example aspect of the invention, a method of operating a thermal control system for a vehicle having a refrigerant loop operable between a cooling mode and a heat pump mode, and a heat exchanger configured to operate as a condenser when operating in the cooling mode and operate as an evaporator when operating in the heat pump mode is provided. In one example implementation, the method includes performing, by a controller having one or more processors, an assessment of ambient conditions; estimating, by the controller, an incremental ice formation on the heat exchanger based on the assessed ambient conditions; and initiating, by the controller, a deicing operation of the heat exchanger when the incremental ice formation exceeds a predetermined threshold.

In addition to the foregoing, the described method may include one or more of the following features: wherein the incremental ice formation is a thickness of ice, and wherein the predetermined threshold is a predetermined threshold thickness; wherein the deicing operation includes switching the refrigerant loop from the heat pump mode to the cooling mode such that hot refrigerant from a compressor transfers thermal energy to the heat exchanger to facilitate melting ice formed thereon; performing, by the controller, a screening test to determine if an icing risk exists for the heat exchanger while operating in the heat pump mode; and wherein the screening test includes determining, by the controller, at least one of the following: (i) determining if the refrigerant loop is operating in the heat pump mode, (ii) determining if a temperature of refrigerant entering the heat exchanger is greater than the ambient temperature, (iii) determining if a saturation temperature of the refrigerant at an exit of the heat exchanger is below zero ° C. or if the ambient temperature is below zero ° C., and (iv) determining if a compressor suction pressure or a vehicle cabin temperature is below a predetermined threshold.

In addition to the foregoing, the described method may include one or more of the following features: wherein when performing the assessment of ambient conditions, the controller identifies one of a first condition with no precipitation or wet pavement, a second condition with wet pavement, but no precipitation, and a third condition with precipitation; determining, by the controller, the presence of precipitation based on one or more signals from a rain sensor and/or a windshield wiper speed, and determining, by the controller, the presence of wet pavement based on traction signals from the vehicle; and wherein when estimating the incremental ice formation, the controller is configured to interpolate, based on the assessed ambient conditions, a table or an artificial neural network for incremental icing versus at least one of the following: an intensity of road splash, an external humidity, the ambient temperature, an airflow to the heat exchanger, a refrigerant state at an inlet of the heat exchanger or an upstream expansion device, a refrigerant pressure at an exit of heat exchanger, and a refrigerant flow.

In addition to the foregoing, the described method may include one or more of the following features: an evaporator disposed on the refrigerant loop downstream of the heat exchanger; and a condenser disposed on the refrigerant loop upstream of the heat exchanger; and a first expansion device disposed downstream of the condenser and upstream of the heat exchanger, and a second expansion device disposed downstream of the heat exchanger and upstream of the evaporator.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
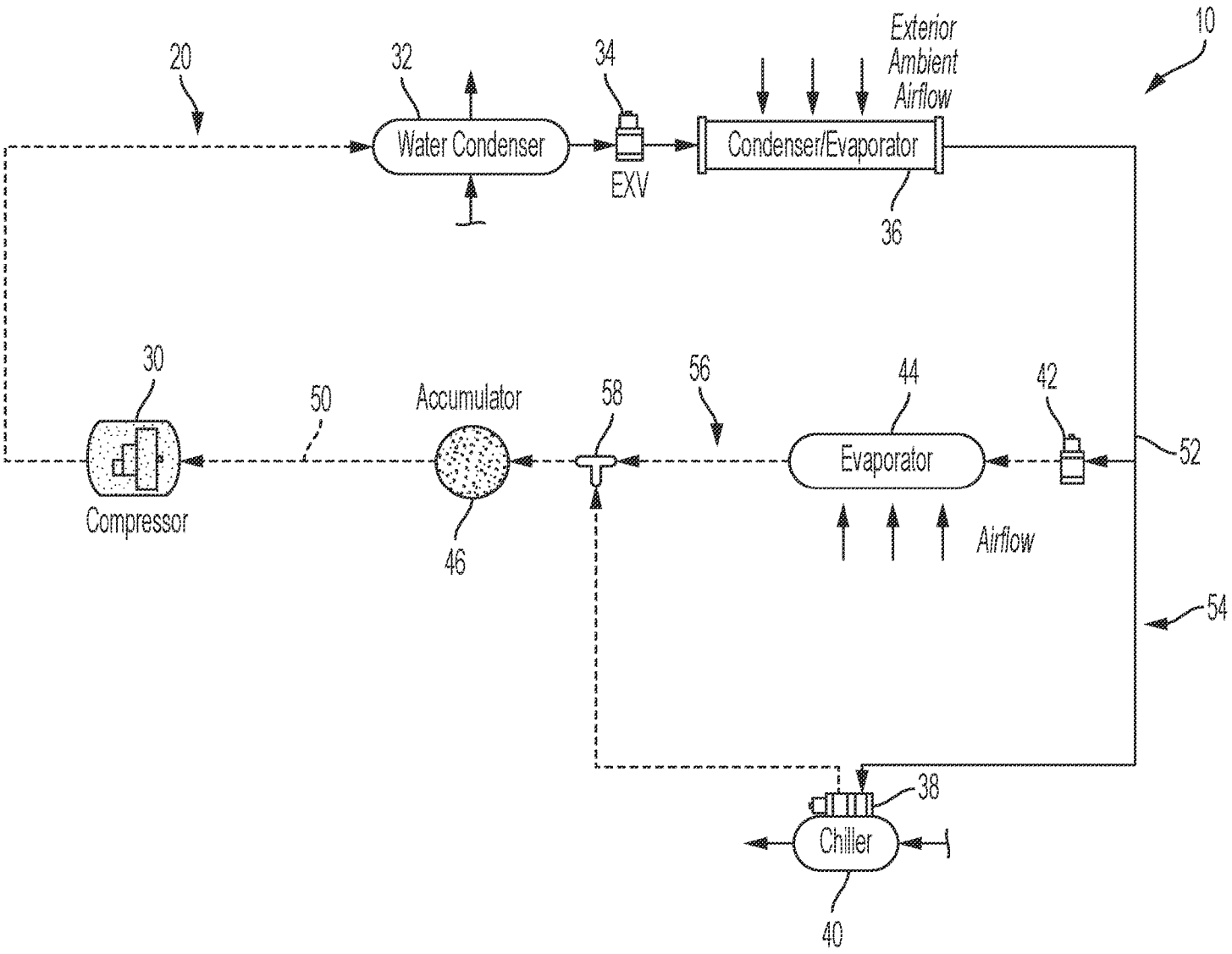
FIG. 1 is a schematic illustration of an example vehicle thermal system in accordance with the principles of the present application.

As discussed above, an EV may operate a thermal system as a heat pump to extract heat from a front-end airstream, even when the ambient temperature is low, and transfer the heat energy to various components such as the vehicle cabin, battery, or electric machines in the EV powertrain. Because of low refrigerant temperatures in the front-end heat exchanger, ice and frost layers may form on the heat transfer surfaces and potentially affect performance of the heat exchanger and thermal system. Since ice detection is difficult, common practice is to periodically deice the front-end heat exchanger ("periodic deicing"), whether or not ice is present. Such periodic deicing fails to account for environmental conditions (e.g., rain), which can lead to underestimation of ice buildup and a potential significant or catastrophic drop in heat exchanger performance. Moreover, this periodic deicing process consumes a significant amount of energy, so unnecessary deicing may dramatically reduce performance.

Accordingly, described herein is a thermal control system configured to estimate a rate of ice buildup and instantaneous ice and frost thicknesses during heat pump operation, while detecting and accounting for various sources of moisture, such as humidity, rain, freezing rain, snow, sleet, wet pavement (road splash), etc. As such, rather than performing periodic deicing, the system estimates the growth of ice and frost over a wide range of operating conditions and considers all practical sources of moisture, thereby dramatically reducing unnecessary deicing operations.

In one example, the EV thermal control system is configured to perform a scheduled deicing of a heat exchanger located at a front of the vehicle while the EV thermal system operates in a heat pump mode. The thermal control system includes an algorithm that is applied at pre-determined time steps and includes (A) screening tests to establish an icing risk and (B) an assessment of the ambient conditions and execution of a deicing operation based on those assessed conditions.

The screening tests are carried out at every time step to determine if an icing risk exists. Example icing risks include: (i) Icing Risk 1—the refrigerant loop is operating in a heat pump mode; (ii) Icing Risk 2—if the refrigerant temperature entering the heat exchanger is higher than the ambient, then heat is leaving the refrigerant at the heat exchanger, and the heat pump is not functioning as desired. First, corrective action is taken, for example by changing the subcool target. If the condition is not resolved within a specified number of cycles, the heat pump is switched off; (iii) Icing Risk 3—for icing to be possible, either (a) the refrigerant saturation temperature at the heat exchanger exit pressure or (b) the ambient temperature must be below freezing. For a less conservative control, the refrigerant exit temperature may be used directly in place of the refrigerant saturation temperature in criterion (a); (iv) Icing Risk 4—at low compressor suction pressure, icing can occur. Also, a fall in cabin temperature can be indicative of icing. If none of the risk factors are present, the deicing operation is not performed.

The assessment of ambient conditions is separated into one or more categories of conditions. In one example, the categories include: Condition 1—conditions with NO wetness (e.g., no rain, freezing rain, snow, sleet, or wet pavement (road splash), etc.); Condition 2—conditions with wet pavement (road splash), but NO precipitation (e.g., no rain, freezing rain, snow, sleet, etc.); and Condition 3—conditions with precipitation and hence wet pavement.

For Condition 1, the thermal control system determines the absence of precipitation, for example, via rain sensors or by determining the vehicle windshield wipers are stationary. The thermal control system determines the absence of wet pavement, for example, via traction signatures relating to slip and grip estimation. For example, the system is configured to sensor or infer both the instantaneous speed of each driven wheel and the net speed of the vehicle overall. This data is then compared, and when a wheel is found to be spinning faster than the vehicle speed, the system intervenes to prevent the condition. For example, Hall effect sensors may be utilized for wheel speed sensing, and vehicle speed may be determined via sensors (e.g., accelerometers) or onboard satellite navigation system data.

Under Condition 1, primary contributors to ice formation rates include (i) ice/frost thickness, (ii) external relative humidity, (iii) ambient temperature, (iv) airflow over the heat exchanger, (v) refrigerant inlet state and exit pressure, and (vi) refrigerant flow. The nominal airflow may be estimated by interpolation of a table generated by physical testing, in which one or more of the following inputs are used: vehicle speed, radiator fan speed, and active grille shutter (AGS) position. The effect of wind velocity, if unavailable, is neglected. Calculation of the actual airflow from the nominal airflow and ice buildup is described herein in more detail.

If external humidity information is available through sensor or connectivity sources, it may be utilized to quantify the relative humidity. If not available, control performs calculations with a predetermined assumed relative humidity (e.g., 90%) to provide a conservative estimate in most cases and a small error if the relative humidity reaches 100%. In some example, real-time wind/weather/humidity information may be accessed using vehicle connectivity and/or cloud data. AI and Neural Network models may also be employed to estimate real-time rainfall using satellite or other data, in support of the control algorithm.

Additionally, the control may utilize a physics-based model that uses the primary contributors to ice formation rates discussed above, and outputs (a) an ice and frost layer growth transient, and (b) a consequent heat transfer performance loss. Such a model may be calibrated against physical prototype data. Parts of the physics-based model may also be utilized within an air-side subsystem flow model to estimate the actual airflow from the nominal airflow and the ice/frost thickness. Moreover, parts of the physics-based model may be used to generate an analytically driven design of experiments (DOE) for training of an artificial neural network (ANN) to produce the outputs of the physics-based model. The ANN may also be calibrated (i) directly against physical prototype data or (ii) with a CAE model, which itself has been calibrated against data, where a custom user-defined function for ice formation is installed.

For Condition 1, deicing is scheduled when at least one additional condition is met. In one example, additional conditions include (i) the ice layer growing beyond a predetermined critical thickness, and (ii) the heat transfer performance loss extending beyond a calibratable acceptable level. Under the additional condition(s), since humidity is the only source of moisture, icing will not occur at low ambient temperatures (e.g., below $T_{crit,low}$) because there is insufficient moisture in the air even at 100% relative humidity. Icing will also not occur above a certain critical ambient temperature (e.g., $T_{crit,high}$) because the warm incoming air will melt any ice formed due to cold refrigerant. The described screening tests may be incorporated into the scheduled deicing algorithm of the thermal control system.

For Condition 2, when the windshield wipers are operating, it is assumed that airborne moisture (precipitation, road splash) is present. The absence of airborne moisture is determined by stationary windshield wipers (or rain sensors, if available). In some instances, road splash may enter through the vehicle front grille, although sufficient airborne moisture may not deposit on the higher located windshield to necessitate wiping. In this case, wet pavement is detected by traction signatures relating to slip and grip estimation. The quantification of "pavement wetness" is utilized as a proxy for the intensity of road splash, as described herein in more detail.

As previously described, the thermal control system may detect precipitation by rain sensors, windshield wiper speed, or by any other suitable method. Quantification of "wetness" from rain sensing and/or windshield wiper speed may be used as a proxy for "windshield wetness" intensity. If the wetness assessment confirms wet pavement, but no precipitation, the intensity of road splash is inferred from traction control information and vehicle speed. Offline, from vehicle or other data, the thermal control system is configured to construct a table or an ANN for incremental icing versus one or more of: intensity of road splash, external humidity, ambient temperature, airflow, refrigerant inlet state and exit pressure, and refrigerant flow. In real time, given the prevalent conditions, the thermal control system interpolates the table or ANN to infer incremental ice buildup and subsequently schedules the next deicing event.

As such, the thermal control system is configured to integrate over transient conditions to obtain cumulative ice buildup conditions between deicing events. When liquid moisture is not present, the physics-based model calculates incremental ice buildup with every time step using instantaneous conditions. Hence, with liquid moisture absent, the cumulative ice buildup under transient humid conditions can be estimated by adding the incremental ice thickness at each time step (e.g., discrete integration of ice thickness).

Figure 4:
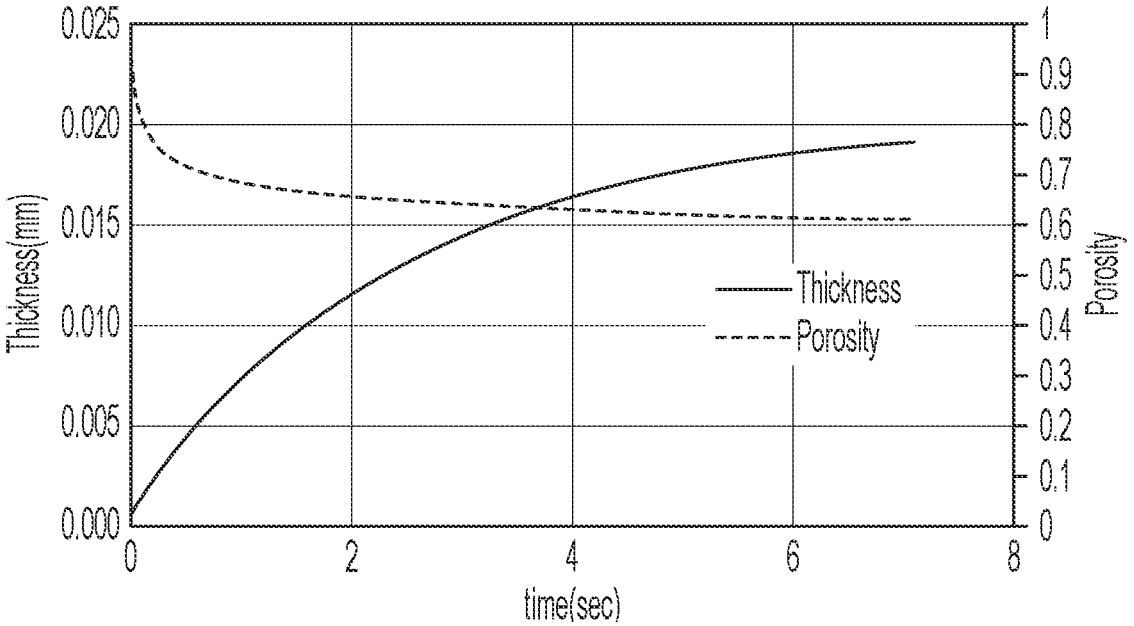
FIG. 4 is an example graph of a rate of ice buildup in the thermal system shown in FIG. 1, in accordance with the principles of the present application.

When liquid moisture is present, the physics-based model is not applicable for estimating ice buildup, but is applicable for estimation of performance degradation as a function of ice thickness. One example method to handle transients includes collecting data under steady state input conditions over a whole icing cycle and then determining an average rate of ice building. This average rate can be used to determine incremental ice buildup over a time step. Such method can be accompanied by a slight error since the rate of buildup varies slightly as the ice thickness increases, for example as shown in FIG. 4, whereas an average rate of buildup is actually being used. In one example, the time derivative of the rate reduces after an initial transient, so the average rate may be a reasonable approximation. If higher accuracy is desired, another example method to handle transients includes tracking ice thickness over the transient, where the input lists described in Conditions 2 and 3 are expanded to include instantaneous ice thickness.

For Condition 3, the thermal control system is configured to detect precipitation and wet pavement, as well as quantify "windshield wetness" and "pavement wetness," as described in Condition 2. As in Condition 2, a table or an ANN is constructed for incremental ice formation, and the procedure is similar except that windshield and pavement wetness are added to the input list. In some cases, pavement wetness effects may be viewed as a correction to windshield wetness effects. For this condition, the real-time control is the same as described in Condition 2.

As such, the algorithm and control of the thermal control system is described above and in the following figures. Although the example vehicle thermal system is described as an indirect heat pump configuration that includes an accumulator as an expansion device, the features described herein may be utilized for other systems such as a direct heat pump system or heat pump system that include a receiver-dryer as an expansion device. It will be appreciated that various features of the control, such as critical temperatures and pressures that demarcate icing risks, are to be calibrated and determined for each particular type vehicle and associated thermal system.

With initial reference to FIG. 1, an example vehicle thermal system is illustrated and generally identified at reference numeral 10. The thermal system 10 is configured to provide heating/cooling to various components of the vehicle such as the electric motor, high voltage battery system, power electronics (e.g., IDCM, PIM) and HVAC. In the example embodiment, the thermal system 10 includes a refrigerant loop 20 operable between an A/C (cooling) mode and a heat pump mode, as is well known in the art. Although not shown, the refrigerant loop 20 may be associated with a high temperature coolant loop, a low temperature coolant loop, and a battery system coolant loop. The refrigerant loop 20 is fluidly isolated from the high temp, low temp, and battery system coolant loops, which may be all fluidly connected by various valves.

In the example implementation, the refrigerant loop 20 is a vehicle air conditioning circuit that generally includes a compressor 30, a condenser 32, a first expansion device 34 (e.g., expansion valve), a condenser/evaporator heat exchanger 36, a second expansion device 38, a chiller 40, a third expansion device 42, an evaporator 44, and an accumulator 46. As previously noted, the refrigerant loop 20 is selectively switchable between the A/C mode and the heat pump mode. As such, depending on the mode of operation, the first heat exchanger 36 functions as either a condenser or an evaporator.

In A/C mode operation, a suction line 50 provides gaseous refrigerant to compressor 30, which subsequently compresses the refrigerant. The resulting compressed and heated refrigerant is then directed through the water condenser 32, which in the example embodiment, is thermally coupled to the vehicle high temperature cooling loop (not shown). In this mode, the first expansion device 34 is open (e.g., no restriction) and the refrigerant is directed to heat exchanger 36, which functions as a condenser to dissipate heat of compression and at least partially condense the refrigerant into a liquid. The cooled refrigerant is then directed to a first junction 52, which divides the coolant flow into a first branch 54 and a second branch 56.

The first branch 54 is configured to supply refrigerant to the second expansion device 38, which is a thermal expansion valve with an integrated shutoff valve. When the shutoff valve is in a closed position, refrigerant is prevented from flowing through first branch 54. When the shutoff valve is in an open position, refrigerant is able to flow through the first branch 54 to the second expansion device 38 where it is reduced in pressure and at least partially vaporized, thereby reducing the temperature of the refrigerant. The cooled vapor refrigerant is then supplied to chiller 40, where it is evaporated to provide cooling, for example, to coolant circulating within the battery system coolant loop (not shown). The resulting gaseous refrigerant is then returned to the compressor 30 via a second junction 58 to the suction line 50 where the cycle is then repeated.

The second branch 56 is configured to supply refrigerant to the third expansion device 42 (e.g., expansion valve), where it is reduced in pressure and at least partially vaporized, thereby reducing the temperature of the refrigerant. The cooled vapor refrigerant is then supplied to evaporator 44, where it is evaporated to providing cooling to the cabin air (e.g., via the HVAC air-handling subsystem). The resulting gaseous refrigerant is then returned to the compressor 30 via suction line 50 and the cycle is repeated.

In the heat pump mode operation, the first expansion device 34 is operated to expand the refrigerant, unlike during the A/C mode. The suction line 50 provides gaseous refrigerant to compressor 30, which subsequently compresses the refrigerant. The resulting compressed and heated refrigerant is then directed through the water condenser 32, where the heat from compression is dissipated into the high temperature coolant loop and hence to the cabin, and the refrigerant at least partially condenses to a liquid. The cooled refrigerant is then supplied to the first expansion device 34 where it is reduced in pressure and at least partially vaporized, thereby reducing the temperature of the refrigerant.

The cooled refrigerant is then supplied to heat exchanger 36, where it is evaporated by absorbing thermal energy from ambient or ram air. As previously discussed, due to the cooled refrigerant entering, ice and frost may form and build up on the heat transfer surfaces of the heat exchanger 36, which is located at a front end of the vehicle. The resulting gaseous refrigerant is then returned to the compressor 30 via first and/or second branches 54, 56 and suction line 50, and the cycle is repeated.

As previously described, the thermal system 10 is configured to selectively perform a deicing operation when ice/frost is detected during operation of the refrigerant loop 20 in the heat pump mode. In one example, performing the deicing operation includes switching operation of the refrigerant loop 20 from the heat pump mode to the A/C mode such that heat exchanger 36 operates as a condenser to melt the built-up ice/frost.

Figure 2:
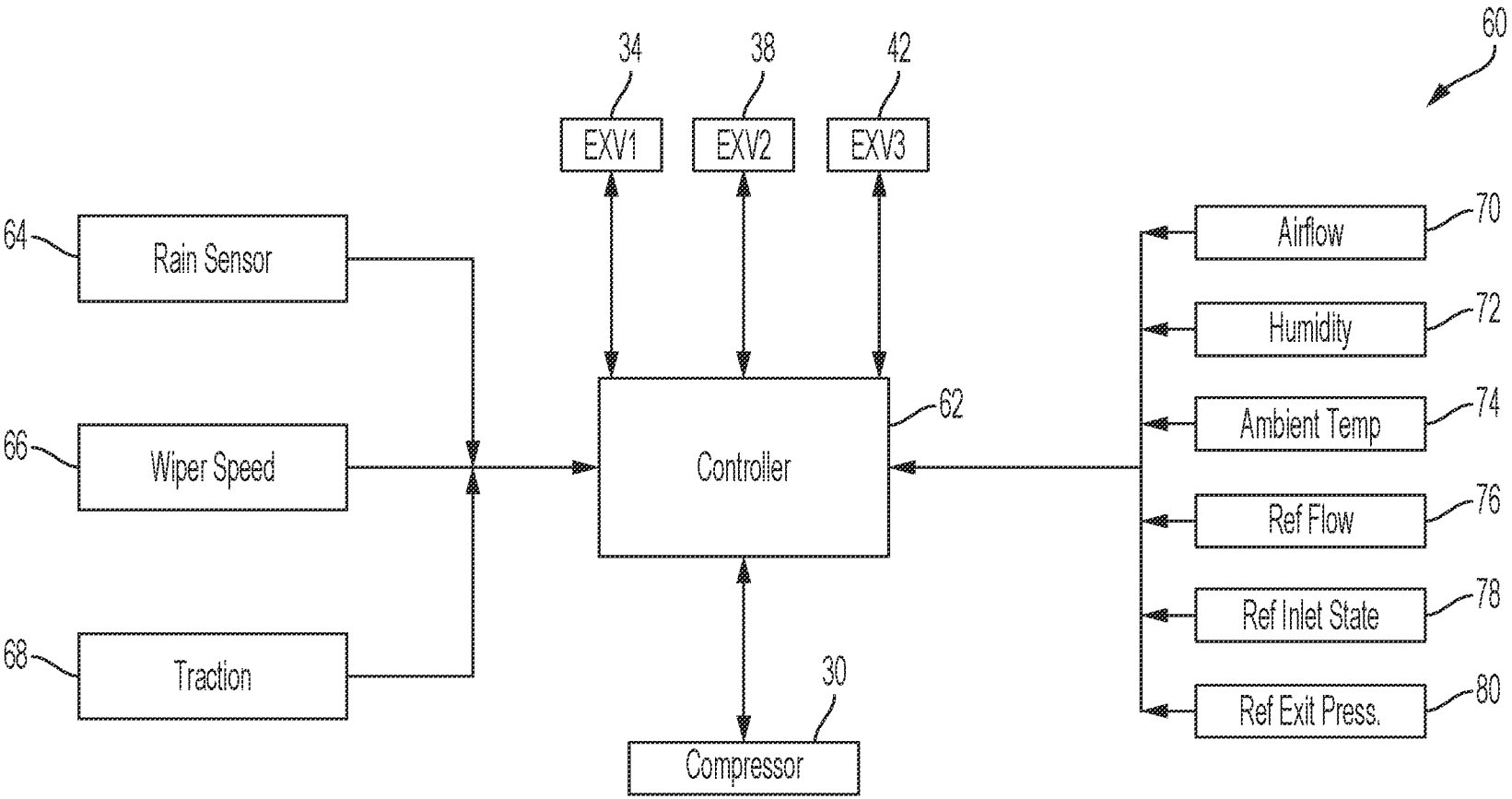
FIG. 2 is a schematic diagram of an example thermal control system in accordance with the principles of the present application.

With reference now to FIG. 2, the thermal system 10 includes a thermal control system 60 to perform the operations described herein. The thermal control system 60 includes a controller 62 such as, for example, an engine control unit (ECU), which is in signal communication with various components, valves, and sensors of the vehicle. In the example embodiment, the controller 62 is in signal communication with one or more rain sensor 64, wiper speed sensor 66, vehicle traction sensor 68 (e.g., Hall effect sensors and accelerometers), airflow sensor 70, humidity sensor 72, ambient temperature sensor 74, refrigerant flow sensor 76, refrigerant inlet state (temperature and pressure) sensor 78, and refrigerant exit pressure sensor 80.

However, in some examples, sensors may be obviated and input data for rain, wiper speed, traction, airflow, humidity, ambient, refrigerant flow, refrigerant inlet state, and/or refrigerant exit pressure may be obtained from calculations or other sources. As such, it will be appreciated that controller 62 may be in signal communication with or receive data from any suitable component that enables thermal control system 60 to function as described herein.

In the example embodiment, the rain sensor 64 is configured to detect precipitation or road splash, for example on the windshield of the vehicle. The wiper speed sensor 66 is configured to detect a speed of the windshield wipers, indicating the presence and intensity of precipitation or road splash. The vehicle traction sensor 68 is configured to detect wet pavement by traction signatures relating to slip and grip estimation. The airflow sensor 70 is configured to measure the airflow over the heat exchanger 36. In some embodiments, the airflow may be determined via other sensor inputs such a vehicle speed, fan speed, and/or AGS position, or alternatively, using a flow model such as a table or ANN that utilizes vehicle speed, fan speed, wind speed and angle, and/or AGS position as inputs. The humidity sensor 72 is configured to sense a relative humidity of the ambient air. In other examples, controller 62 receives such data from another system (e.g., cloud data for that location).

The ambient temperature sensor 74 is configured to sense a temperature of the ambient air. In other examples, controller 62 receives such data from another system. The refrigerant flow sensor 76 is configured to sense a refrigerant flow rate in the refrigerant loop 20, for example, upstream of expansion device 34 and/or downstream of heat exchanger 36. The refrigerant inlet state sensor 78 is configured to sense the state of the refrigerant (e.g., temperature and/or pressure) at an inlet of the expansion device 34. The refrigerant exit pressure sensor 80 is configured to sense a pressure of the refrigerant at the exit of the heat exchanger 36. This may be utilized to determine heat transfer in the heat exchanger 36, for example, to be used in the physics-based model to estimate ice buildup.

Figure 3A:
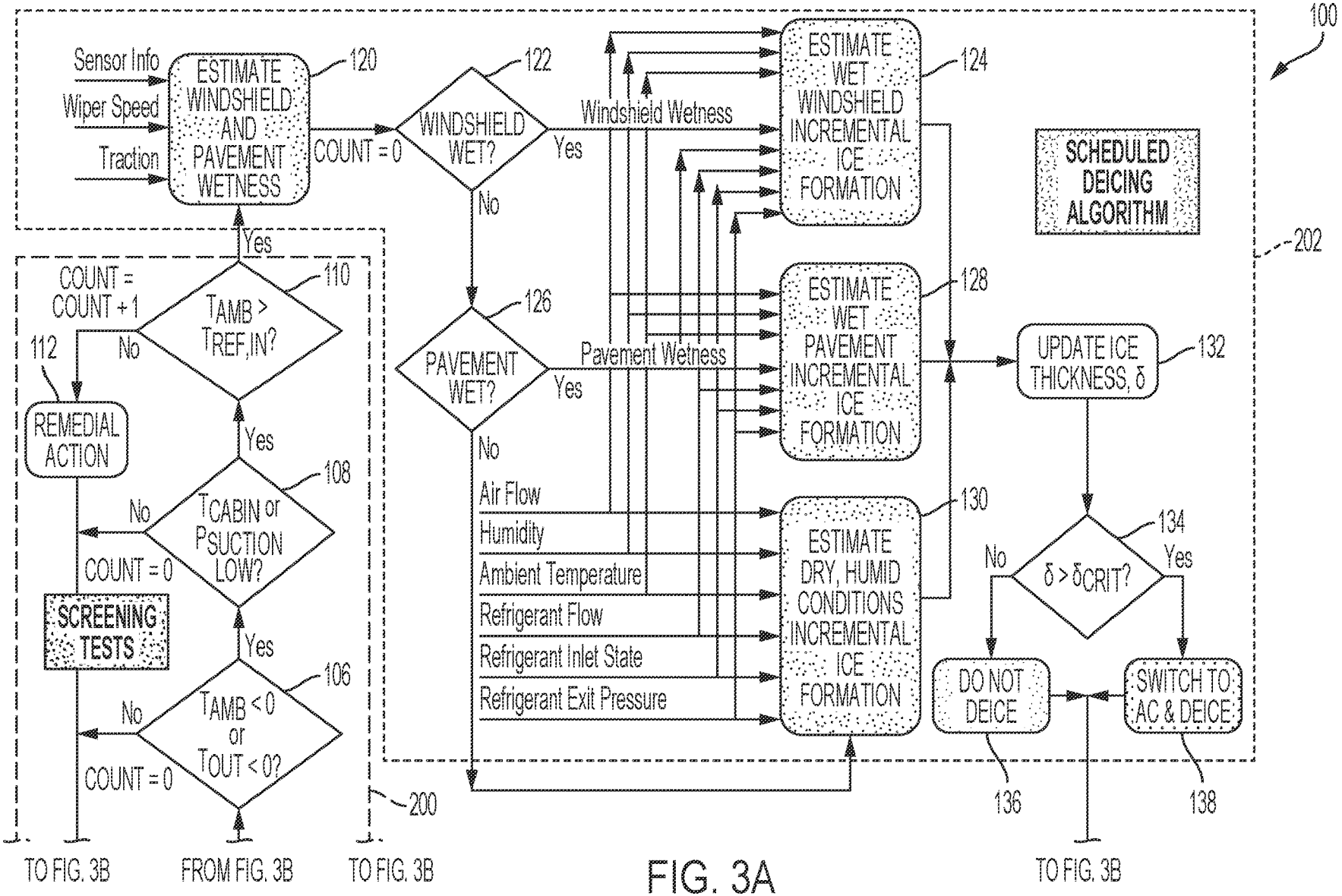
FIGS. 3A-3B illustrate an example control logic flow for a scheduled deicing of the thermal system shown in FIG. 1, in accordance with the principles of the present application.
Figure 3B:
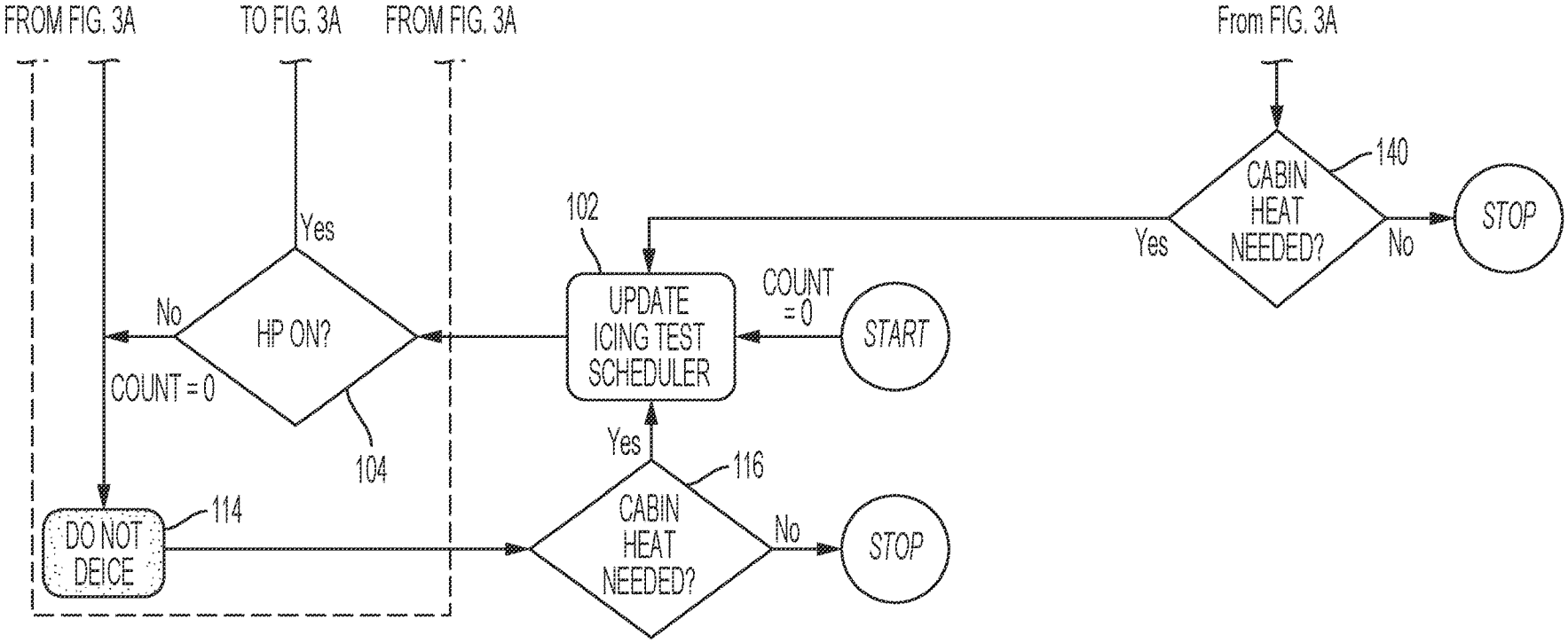

With reference now to FIGS. 3A and 3B, an example method 100 of operating thermal control system 60 to evaluate the need for and execute a deicing operation ("scheduled deicing") will be described. The method begins at step 102 (FIG. 3B) where controller 62 (control) updates the icing test scheduler with heat pump operation time since a last deicing. Next, control proceeds to a series of one or more screening tests 200 (steps 104-110) to determine an Icing Risk, as previously described herein. It will be appreciated that screening tests 200 may be performed simultaneously or in any desired order. At step 104, control determines if the heat pump is on. In other words, control determines if refrigerant loop 20 is being operated in the heat pump mode. If no, control proceeds to step 114 and does not initiate a deicing operation (e.g., switching refrigerant loop 20 operation to the A/C mode). Control then proceeds to step 116 and determines if cabin heat is requested (e.g., via HVAC controls). If yes, control returns to step 102. If no, control ends.

Returning to step 104, if the heat pump is on, control proceeds to step 106 and determines if the ambient temperature ($T_{AMB}$) is less than 0° C. or the refrigerant saturation temperature at the heat exchanger outlet (Tour) is less than 0° C. If no, control proceeds to step 114 and does not initiate deicing. If yes, at step 108, control determines if the cabin temperature $T_{CABIN}$ or the compressor suction pressure $P_{SUCTION}$ is low (e.g., below a predetermined threshold). If no, control proceeds to step 114 and does not initiate deicing. If yes, control proceeds to step 110 and determines if the ambient temperature ($T_{AMB}$) is greater than the refrigerant temperature at the heat exchanger inlet ($T_{REF,IN}$). If no, at step 112, control determines heat pump operation is ineffective and takes remedial action. For example, the remedial action includes updating the subcool target if a COUNT of remediation attempts is less than a predetermined maximum threshold. Otherwise, the heat pump mode is temporarily switched OFF and electric coolant heaters are utilized to perform the cabin and/or component heating functions. Control then proceeds to step 114.

Returning to step 110, if $T_{AMB}$ is greater than $T_{REF,IN}$ then the screening tests 200 indicate an Icing Risk is possible and control executes the scheduled deicing algorithm 202 (steps 120-138). Accordingly, control proceeds to step 120 and controller 62 estimates windshield and pavement wetness. In the example embodiment, to make this determination, control receives input from rain sensors 64, wiper speed sensors 66, and/or traction sensors 68. At step 122, control determines if the windshield wetness determined in step 120 is above a predetermined threshold. If yes, control proceeds to step 124. If no, control proceeds to step 126.

At step 124, control estimates wet windshield incremental ice formation on the heat exchanger 36, for example, as described for Condition 3 (e.g., using the constructed table/ANN and interpolation). In the example embodiment, to make this determination, control receives input from one or more of sensors 70-80. Control then proceeds to step 132 and updates the estimated ice thickness on the heat exchanger 36.

At step 126, control determines if the pavement wetness determined in step 120 is above a predetermined threshold. If yes, control proceeds to step 128. If no, control proceeds to step 130.

At step 128, control estimates wet pavement incremental ice formation on the heat exchanger 36, for example, as described for Condition 2 (e.g., using the constructed table/ANN and interpolation). In the example embodiment, to make this determination, control receives input from one or more of sensors 70-80. Control then proceeds to step 132 and updates the estimated ice thickness on the heat exchanger 36.

At step 130, control estimates dry and humid conditions incremental ice formation on the heat exchanger 36, for example, as described for Condition 1 (e.g., using the constructed table/ANN and interpolation). In the example embodiment, to make this determination, control receives input from one or more of sensors 70-80. Control then proceeds to step 132 and updates the estimated ice thickness on the heat exchanger 36.

Once the estimated ice thickness is updated from steps 124, 128 or 130, control proceeds to step 134 and determines if the updated ice thickness is greater than a predetermined critical thickness. If no, control proceeds to step 136 and does not perform the deicing operation. If yes, control proceeds to step 138 and performs the deicing operation. In the example operation, the deicing operation includes switching the refrigerant loop 20 from the heat pump mode to the A/C mode such that heat exchanger 36 functions as a condenser. As such, heat from the compressed refrigerant from the compressor 30 is utilized to melt the ice buildup on the heat exchanger 36.

Control then proceeds to step 140 from either of steps 136, 138 and controller 62 determines if there is a request for cabin heating (e.g., from in-cabin HVAC controls). If yes, control returns to step 102. If no, control ends.

Described herein are systems and methods for deicing control of a thermal system of an electric vehicle. When the thermal system operates in a heat pump mode, there is a risk of ice buildup on a front-end heat exchanger under certain conditions. A thermal control system performs screening tests to assess an icing risk to the heat exchanger. When an icing risk is present, the thermal control system estimates windshield and pavement wetness conditions and subsequently estimates an incremental ice formation based on those conditions. When estimated ice thickness exceeds a predetermined level, a deicing operation is commenced.

It will be appreciated that the term "controller" or "module" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present application, its application or uses. Thus, variations that do not depart from the gist of the present application are intended to be within the scope of the present application.

What is claimed is:

1. A thermal system for a vehicle, comprising:

a refrigerant loop operable between a cooling mode and a heat pump mode;

a compressor configured to circulate a refrigerant through the refrigerant loop;

a heat exchanger disposed on the refrigerant loop and configured to operate as a condenser when operating in the cooling mode and operate as an evaporator when operating in the heat pump mode; and a thermal control system including a controller having one or more processors, the controller being in signal communication with one or more sensors of the vehicle, the controller programmed to:

perform, based on input from the one or more sensors, a screening test to determine if an icing risk exists for the heat exchanger while operating in the heat pump mode;

estimate, in response to the screening test indicating an icing risk, a windshield wetness and a pavement wetness based on input from the one or more sensors;

estimate an incremental ice formation on the heat exchanger based on the estimated windshield wetness and pavement wetness; and initiate a deicing operation of the heat exchanger when the incremental ice formation exceeds a predetermined threshold.

2. The thermal system of claim 1, wherein the incremental ice formation is a thickness of ice, and wherein the predetermined threshold is a predetermined threshold thickness.

3. The thermal system of claim 1, wherein the deicing operation includes switching the refrigerant loop from the heat pump mode to the cooling mode such that hot refrigerant from the compressor transfers thermal energy to the heat exchanger to facilitate melting ice formed thereon.

4. The thermal system of claim 1, wherein the screening test includes each of the following:

(i) determining if the refrigerant loop is operating in the heat pump mode;

(ii) determining if a temperature of the refrigerant entering the heat exchanger is greater than the ambient temperature;

(iii) determining if a saturation temperature of the refrigerant at an exit of the heat exchanger is below zero ° C. or if the ambient temperature is below zero ° C.; and (iv) determining if a compressor suction pressure or a vehicle cabin temperature is below a predetermined threshold.

5. The thermal system of claim 1, wherein when performing the estimation of windshield and pavement wetness, the controller identifies one of:

a first condition with no precipitation or wet pavement;

a second condition with wet pavement, but no precipitation; and a third condition with precipitation.

6. The thermal system of claim 5, further comprising:

wherein the controller determines the presence of precipitation based on one or more signals from a rain sensor and/or a windshield wiper speed; and wherein the controller determines the presence of wet pavement based on traction signals from the vehicle.

7. The thermal system of claim 1, wherein when estimating the incremental ice formation, the controller is further programmed to interpolate, based on the estimated windshield and pavement wetness, a table or an artificial neural network for incremental icing versus at least one of the following: an intensity of road splash, an external humidity, the ambient temperature, an airflow to the heat exchanger, a refrigerant state at an inlet of the heat exchanger or an upstream expansion device, a refrigerant pressure at an exit of heat exchanger, and a refrigerant flow.

8. The thermal system of claim 1, further comprising:

an evaporator disposed on the refrigerant loop downstream of the heat exchanger; and a condenser disposed on the refrigerant loop upstream of the heat exchanger.

9. The thermal system of claim 8, further comprising:

a first expansion device disposed downstream of the condenser and upstream of the heat exchanger; and a second expansion device disposed downstream of the heat exchanger and upstream of the evaporator.

10. The thermal system of claim 1, further comprising:

a condenser disposed on the refrigerant loop downstream of the compressor and upstream of the heat exchanger;

a first expansion device disposed downstream of the condenser and upstream of the heat exchanger;

a junction downstream of the heat exchanger that splits the refrigerant loop into a first branch and a second branch;

a chiller disposed on the first branch;

a second expansion device disposed on the first branch and including an integrated shutoff valve to selectively prevent refrigerant flow through the first branch;

an evaporator disposed on the second branch; and a third expansion device disposed on the second branch upstream of the evaporator.

11. A method of operating a thermal control system for a vehicle having a refrigerant loop operable between a cooling mode and a heat pump mode, and a heat exchanger configured to operate as a condenser when operating in the cooling mode and operate as an evaporator when operating in the heat pump mode, the method comprising:

performing, by a controller having one or more processors, a screening test to determine if an icing risk exists for the heat exchanger while operating in the heat pump mode;

estimating, by the controller and in response to the screening test indicating an icing risk, a windshield wetness and a pavement wetness;

estimating, by the controller, an incremental ice formation on the heat exchanger based on the estimated windshield wetness and pavement wetness; and initiating, by the controller, a deicing operation of the heat exchanger when the incremental ice formation exceeds a predetermined threshold.

12. The method of claim 11, wherein the incremental ice formation is a thickness of ice, and wherein the predetermined threshold is a predetermined threshold thickness.

13. The method of claim 11, wherein the deicing operation includes switching the refrigerant loop from the heat pump mode to the cooling mode such that hot refrigerant from a compressor transfers thermal energy to the heat exchanger to facilitate melting ice formed thereon.

14. The method of claim 11, wherein the screening test includes each of the following:

(i) determining, by the controller, if the refrigerant loop is operating in the heat pump mode;

(ii) determining, by the controller, if a temperature of refrigerant entering the heat exchanger is greater than the ambient temperature;

(iii) determining, by the controller, if a saturation temperature of the refrigerant at an exit of the heat exchanger is below zero ° C. or if the ambient temperature is below zero ° C.; and (iv) determining, by the controller, if a compressor suction pressure or a vehicle cabin temperature is below a predetermined threshold.

15. The method of claim 11, wherein when performing the estimation of windshield and pavement wetness, the controller identifies one condition chosen from the set of:

a first condition with no precipitation or wet pavement;

a second condition with wet pavement, but no precipitation; and a third condition with precipitation.

16. The method of claim 15, further comprising:

determining, by the controller, the presence of precipitation based on one or more signals from a rain sensor and/or a windshield wiper speed; and determining, by the controller, the presence of wet pavement based on traction signals from the vehicle.

17. The method of claim 11, wherein when estimating the incremental ice formation, the controller is configured to interpolate, based on the estimated windshield and pavement wetness, a table or an artificial neural network for incremental icing versus at least one of the following: an intensity of road splash, an external humidity, the ambient temperature, an airflow to the heat exchanger, a refrigerant state at an inlet of the heat exchanger or an upstream expansion device, a refrigerant pressure at an exit of heat exchanger, and a refrigerant flow.

18. The method of claim 11, further comprising:

an evaporator disposed on the refrigerant loop downstream of the heat exchanger;

and a condenser disposed on the refrigerant loop upstream of the heat exchanger.

19. The method of claim 18, further comprising:

a first expansion device disposed downstream of the condenser and upstream of the heat exchanger; and a second expansion device disposed downstream of the heat exchanger and upstream of the evaporator.

20. The method of claim 11, further comprising:

a condenser disposed on the refrigerant loop downstream of the compressor and upstream of the heat exchanger;

a first expansion device disposed downstream of the condenser and upstream of the heat exchanger;

a junction downstream of the heat exchanger that splits the refrigerant loop into a first branch and a second branch;

a chiller disposed on the first branch;

a second expansion device disposed on the first branch and including an integrated shutoff valve to selectively prevent refrigerant flow through the first branch;

an evaporator disposed on the second branch; and a third expansion device disposed on the second branch upstream of the evaporator.

* * * * *